US010017226B2

(12) United States Patent
Kalil

(10) Patent No.: US 10,017,226 B2
(45) Date of Patent: Jul. 10, 2018

(54) MOLDED PONTOON BOAT WITH INTEGRATED DECK AND HULL COMPONENTS

(71) Applicant: Anthony Kalil, Palm City, FL (US)

(72) Inventor: Anthony Kalil, Palm City, FL (US)

( * ) Notice: Subject to any disclaimer, the term of this patent is extended or adjusted under 35 U.S.C. 154(b) by 0 days.

(21) Appl. No.: 15/258,649

(22) Filed: Sep. 7, 2016

(65) Prior Publication Data

US 2017/0217542 A1 Aug. 3, 2017

Related U.S. Application Data

(63) Continuation of application No. 14/688,500, filed on Apr. 16, 2015, now abandoned, which is a continuation of application No. 13/867,785, filed on Apr. 22, 2013, now abandoned.

(60) Provisional application No. 61/636,260, filed on Apr. 20, 2012.

(51) Int. Cl.

| | |
|---|---|
| ***B63B 1/00*** | (2006.01) |
| ***B63B 1/12*** | (2006.01) |
| ***B63B 29/04*** | (2006.01) |
| ***B63B 29/10*** | (2006.01) |
| ***B63B 5/24*** | (2006.01) |
| ***B63B 35/34*** | (2006.01) |

(52) U.S. Cl.

CPC ..... *B63B 1/121* (2013.01); *B63B 5/24* (2013.01); *B63B 29/04* (2013.01); *B63B 29/10* (2013.01); *B63B 35/34* (2013.01); *B63B 2029/043* (2013.01); *B63B 2231/52* (2013.01)

(58) Field of Classification Search

CPC ..... B63B 29/14; B63B 1/121; B63B 29/04; B63B 15/00; B63B 19/00; B63B 29/10

USPC ..... 114/61.1, 77 R, 77 A, 271, 292, 355

See application file for complete search history.

(56) References Cited

U.S. PATENT DOCUMENTS 5,209,177 A * 5/1993 Granie ..... B63B 1/12 114/343

7,987,803 B2 * 8/2011 Cochran ..... B63B 35/34 114/258

* cited by examiner

*Primary Examiner* — Daniel V Venne

(74) *Attorney, Agent, or Firm* — Saliwanchik, Lloyd & Eisenschenk

(57) ABSTRACT

A fiberglass pontoon boat, having raised and integrated fiberglass side rails, a flat floor, and a side entry level with the flat floor. Integrated seats are molded in fiberglass. The hull and deck join together by flexing the hull to compensate for opposing draft angles of the hull and deck at the side entry. The deck has a floor and at least one other interior component, and terminates in a deck trim flange. The hull has at least two hollow pontoons and at least two side rails that extend from an outer edge of the pontoons, and the hull terminates in a hull trim flange. When assembled, the hull trim flange operatively engages beneath the deck trim flange to form a unified pontoon boat having a space between the deck and hull and wherein the side rails are integrated as structural parts of the interior component.

10 Claims, 18 Drawing Sheets

DECK 20
(23)
FLOOR LEVEL
06
HULL
05
07

05
DECK
20
FLOOR LEVEL
07
06
HULL
(25)

FLOOR LEVEL
01
DECK 02
HULL
03
FLAT
FLOOR
PONTOON
TRADITIONAL
SIDE

DECK
HULL
03
(01)
02

FRONT

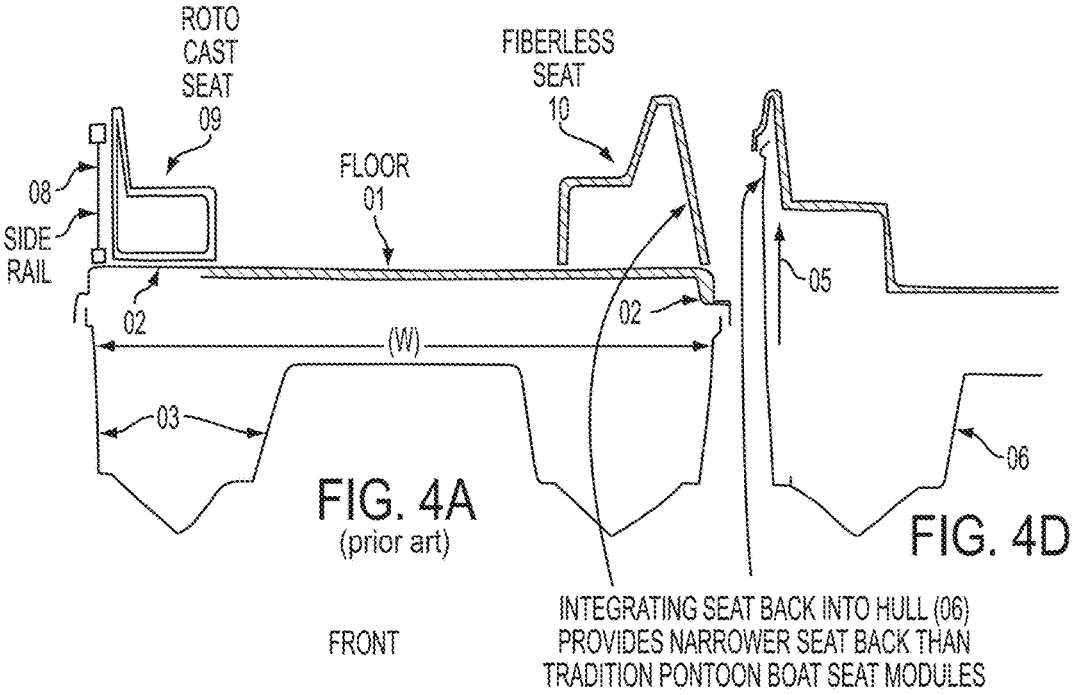
FIG. 4A
(prior art)
FIG. 4D
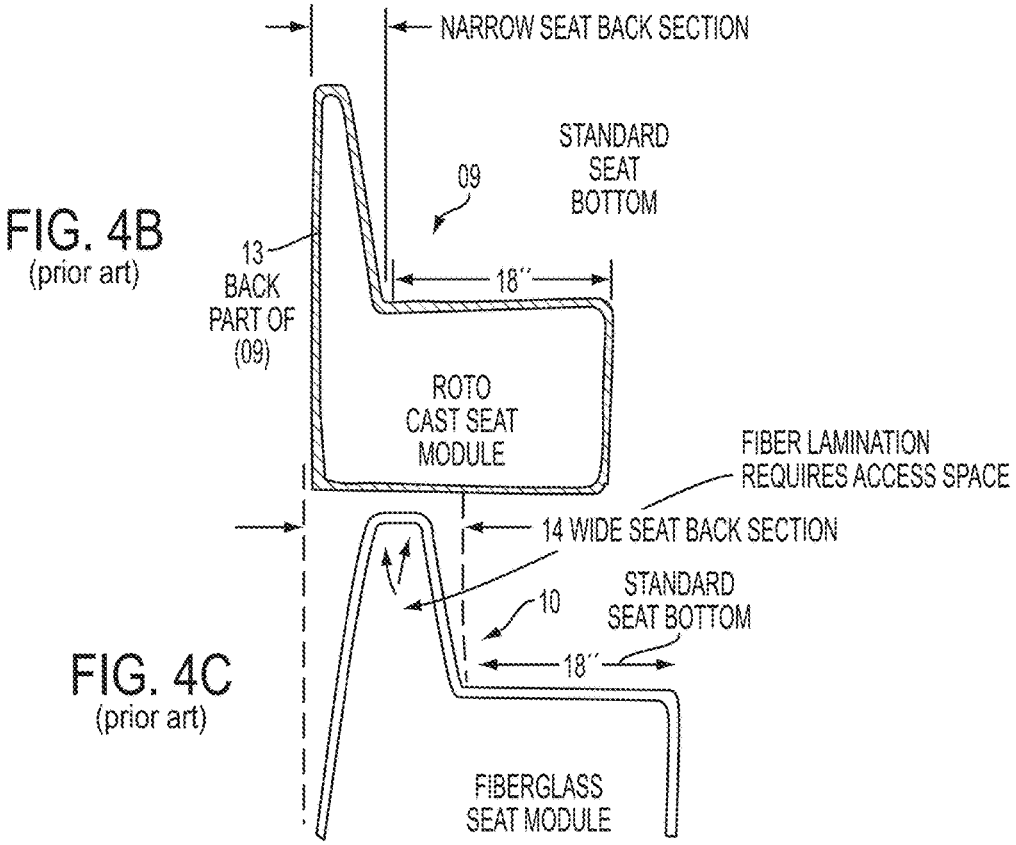
FIG. 4B
(prior art)
FIG. 4C
(prior art)

MOLDED PONTOON BOAT WITH INTEGRATED DECK AND HULL COMPONENTS

CROSS-REFERENCE TO RELATED APPLICATIONS

This application is a continuation of U.S. application Ser. No. 14/688,500, filed Apr. 16, 2015, which is a continuation of U.S. application Ser. No. 13/867,785, filed Apr. 22, 2013, which claims the benefit of U.S. Provisional Application Ser. No. 61/636,260, filed Apr. 20, 2012, which are herein incorporated by reference in their entirety.

FIELD OF THE INVENTION

This invention relates to the field of pontoon boats. More particularly the invention relates to a pontoon boat that includes modifications in design and fiberglass construction with integrated railings resulting in features that improve the overall pontoon boat.

BACKGROUND

Pontoon boats are a type of boat that is extremely popular with boaters today. Pontoon boats are usually constructed out of aluminum, wood, fiberglass, and upholstery. Historically, they have been a very popular segment of the boating industry, because they offer features that appeal to elderly boaters, or those with limited mobility. The features that make them popular to this buying group are a natural bi-product created by the construction techniques used to manufacture pontoon boats.

Pontoon boats historically have two or more separate hulls that displace water at the corners of the boat, instead of mono-hull design boats that have only one hull, or one encompassing waterline to displace the weight of the boat. Pontoon boats get their name from the pontoon hulls that are made from round tubes rolled out of aluminum. Recently, round hull shapes have been enhanced by the addition of strakes, or even completely new shapes to improve the hull's performance to create competitive advantage.

A key selling point to traditional pontoon boats is the very wide interior volume of the boat. Since most boats from 16-29 feet are towed on trailers, they are constructed with a maximum legal road width of 8 foot and 6 inches. Since all trailerable boats share this maximum width, careful attention is paid to maximize the interior width to establish competitive advantage. All of the components of the boat are engineered to maximize this interior width, which has proven to be a major selling factor for pontoon type boats. Traditional fiberglass boats do not offer interior widths that are comparable to aluminum pontoon boats, due to the nature of their construction techniques, and the necessary side wall thickness needed to laminate fiberglass.

Due to the increased popularity of the pontoon style boat, additional features have been added to the boats in the past few years to add competitive edge. New furniture styles with improved quality and features, as well as new fiberglass modules that incorporate driver's seat risers, entertainment and wet bar stations, and ottomans are now commonplace in the pontoon industry. As a result, pontoon boats have increased in weight over the past few years with the addition of new features and amenities. To offset the additional weight of pontoon boats, manufacturers have recently introduced a third, or center pontoon to help displace the additional weight of the new improvements. This new genre of pontoon boat is often referred to as a Tri-Toon.

The Tri-Toon has become a very popular segment of the aluminum pontoon boat market; however, increased costs of wood, plastics, aluminum, and vinyl have made them prohibitively expensive to build. Additionally, the traditional aluminum construction is prohibitive to many of the modern features being pioneered in other segments of the boating industry.

Construction

Pontoon hulls have been developed in aluminum, and some even made out of plastic or fiberglass. Pontoon tubes are constructed separately from the rest of the structure of the boat, and assembled with mounting hardware that is usually welded to the tube, giving it a dedicated "top side" to which the rest of the boat is assembled on top of.

Traditional pontoon boats are constructed by securing aluminum cross beams over the assembled tubes. This creates a grid that forms the foundation of the pontoon boat, as shown in FIG. 1.

The grid is welded or bolted on top of the pontoon mounts that extend up on top of the traditional round tube. This pontoon mount extends upward, and separates the tube from the bottom of the channels to give extra clearance between the hull's running waterlines.

Floor boards are then secured to the aluminum channels. Floor boards are most commonly ply wood panels, however, composite plastic floors or aluminum planks can also be utilized. Carpeting, vinyl flooring, or decorative wood or faux wood planks are then added to complete the deck floor. The deck floor covers the entire floor plan of the boat, even though much of the floor, carpet, vinyl, or decking will eventually be covered by furniture, driver's consoles, and other equipment.

An outer rub rail is secured to the perimeter of the deck floor to finish it off. Once the deck floor is finished, manufacturers add the side rails, furniture, helm console, and other related components to the deck of the pontoon boat. Wet bars, galley units, or any other furniture fixture is arranged and secured in place to complete the pontoon boat, as shown, for example, in FIG. 2.

The rails are usually made out of a combination of welded aluminum tubes and aluminum or plastic panels. These construction techniques are very conducive to maximizing interior width; since the overall width of the rails is usually about 1½ inches wide.

Furniture is historically made out rotationally molded plastic bases or aluminum tubes, which are covered with foam and vinyl to create seating modules. Aluminum frame, or rotationally molded seat bases are instrumental to creating comfortable pontoon boats, since the nature of the construction allows the seats to be built with a very narrow backrest section. Aluminum tubes are welded to create seating modules where the backrests are no wider than the aluminum tube. This creates a very narrow backrest, which translates into a wide interior volume; however, the shapes attainable with aluminum construction do not allow aesthetically pleasing shapes. Most pontoon interiors instead rely on a rotationally molded mold to create pleasing shapes.

A rotational mold is a two piece cavity tool that is joined to completely encapsulate the cavity, filled with plastic pellets, and then heated to melt the pellets. The tool is then rotated in a large fixture that uses gravity to evenly distribute the molten pellets into the narrow spaces of the tool. The narrow distance from the inner and outer backrest allows the seat module to be built without wasting extra space. This allows a maximum usable interior width, since the seat backs do not intrude into the interior space. Similar seating modules have been historically difficult to construct in fiberglass, since the nature of the fiberglass material and its application process needs much larger openings to manually roll the fiberglass by hand into the cavities. In comparison, rotationally molded seat bases utilize gravity to flow the material into very narrow cavities. Consequently, fiberglass seating bases have not been competitive, since the large amounts of clearance to build the seat backs intrudes into the interior to a large degree, creating limited seating areas.

Helm stations are normally made out of fiberglass or plastic, however, the nature of the construction means that they must be finished on the interior side of the console, as well as the outer side, which is normally placed up against the side fence of the pontoon boat. This wastes some space, since the outside of the fiberglass sits inside the inner side of the aluminum fence, however, the nature of the construction of the typical aluminum construction-pontoon boat prevents any improvement to this design.

Other features such as changing rooms, or on-board restroom facilities, are constructed out of aluminum tubes, furniture, and rotationally molded bases to create small quarters. Generally, an aluminum fold up frame is enclosed with canvas curtains in order to allow privacy, since the changing room's necessary headroom for adults to stand inside (approx 6' or more) is well above the height of the furniture, which rarely extends above 3 feet tall. Stepping down past the floor of a pontoon boat is very difficult, due to the nature of the wood floor over aluminum channel construction, and the separation of the tubes from the bottom of the deck, so pop up changing rooms are essential in a typically constructed pontoon boat.

Appeal of Traditional Aluminum Pontoon Boats

Because the aluminum and wood pontoon deck is created on a completely flat platform, the boats appeal greatly to elderly boaters or those with limited mobility since the floating deck height is usually within inches of a floating dock that the boat is boarded from. This allows easy access to the boat from the dock, since there are no high sides or structures to step over in order to board the boat from the side. Conversely, traditional fiberglass boats have been built as ocean-going vessels with careful attention paid to deep hulls that can overcome large waves and sea conditions, so they traditionally have high sides that extend well above the floor level, making entry from the sides very difficult.

Additionally, the wood and aluminum deck has no hardware or raised step like a tall fiberglass hull's bow stem at the front of the boat, so there are no objects to trip over when boarding directly from the front of the boat. Entry doors are commonly located at 3 or 4 places on the boat including one or both sides, the front of the boat, and the rear of the boat, allowing easy boarding from the dock to the completely flat floor of the pontoon boat in any situation. Ease of entry for elderly boaters, or boaters with limited mobility is definitely a major factor in the success of aluminum pontoon boats, over traditional fiberglass boats.

Another appeal of pontoon boat to similar buyers is the stability of the pontoon hull. Conventional pontoon boats, and Tri-toon pontoon boats with the addition of a center hull, displace water at the outer-most corners. Consequently, they are very stable in roll, and they are not as sensitive to weight changes at the corners as a traditional fiberglass V-hull design. Because the V-hull design displaces the most water at its deepest point which is down at the center of the boat, V hulls have a noticeable tendency to roll, or rock to the side when weight is placed to the side. This design attribute makes the pontoon boat much easier to board for elderly or limited mobility boaters, because the platform they are boarding remains stable, and assures solid footing for safe entry and egress.

Improvements Over Traditional Aluminum Pontoon Boats

While the traditional aluminum pontoon boat has many advantages over a fiberglass boat, it also has several disadvantages. Due to the nature of the aluminum channel floor's construction techniques, it is prohibitively expensive to penetrate the floor, and allow access to any compartments below decks. Some manufacturers make a special access hatches in the center of the floor to access small portions of the center tube in a Tri-toon design, however, the weakening of the structural floor caused by the cutting out of the cross channels makes penetrating the floor with large openings difficult. Additionally, since the tubes are generally separated from the deck by the raised pontoon mounts; considerable expense must be spent to engineer a water tight chamber to seal off the top of the tube to the bottom of the deck. These access hatches can only be placed in a specific location on a traditional aluminum pontoon boat, in order to keep the boat sea-worthy.

Since penetrating the floor is prohibitively expensive, it also makes stepping down into a head compartment or changing room difficult. Consequently, changing rooms on pontoon boats are traditionally at the aft section of the boat, and feature pop-up curtains to maintain privacy, however, marketing research has proven that most buyers of pontoon boats are not happy with the accommodations offered by traditional aluminum pontoon boats.

Additionally, boarding ladders are normally found only at the aft platform of a pontoon boat, since the ladder cannot fold away into a floor penetrating compartment, and therefore must be attached as an extension of the platform. Side and bow boarding ladders would not work in this manner, since they would hang off the side of the boat and extend the maximum width of the boat past it's 8-6" wide legal limit, or create a dangerous extension from the boat's rub rail. The only provisions aluminum pontoon boats have for side or forward boarding ladders, are ladders that must be physically removed and stored elsewhere. This type of ladder cannot be retrieved while in the water, and must rely on a second person to assist with the deployment of the ladder.

The construction techniques of aluminum pontoon boats also affect their performance and efficiency in several ways. First, aluminum tubes, which are most often round, are not well suited to hydrodynamic efficiency. Consequently, many manufacturers add "chines" or lifting strakes to the pontoon hulls in order to allow them to break the surface of the water, and relieve suction. This second process adds considerable costs to the pontoon manufacturing process. Next, the aluminum cross channels underneath the deck of the boat act as water brakes, since they are positioned at 90' to the water rushing below. Even small and moderate sized waves will strike the channels on the under-deck, and cause a surging effect that slows the traditional aluminum pontoon when underway. Additional aluminum under deck shields that cover the cross channels are offered by some manufacturers, however, they are considerably expensive. Consequently, most pontoon boats are not designed for speed, since it is prohibitively expensive to make them perform up to traditional fiberglass boat standards.

Other disadvantages of traditional pontoon boats can be found in the construction of the interior. Rotationally molded seat bases generally have a "rough type of texture" formed by the rough surface of the cavity tool, and are not aesthetically pleasing to look at. Consequently, most manufacturers cover the entire seating assemblies in rich vinyl. These vinyls are very expensive, since they are designed to resist the sun's ultraviolet rays; however, they are very sensitive to damage and tearing. In addition, covering the rotationally molded seat bases is extremely inefficient, since the bottom, back sides, and inner edges of the seat bases will not be seen, yet they need to be covered completely due to the nature of the vinyl sewn cover. This leaves only about 35% of the vinyl surface visible to the eye.

Similar inefficiencies can be found in the construction of the deck, since over 60% of most pontoon boats floor coverings are covered by seating or other assemblies, even though 100% of the floor level is finished. This means that only a small fraction of the carpet, wood, and vinyl flooring are utilized, or left available to walk on.

Rotationally molded seat bases also offer several other disadvantages, such as limited access to storage, small storage capacities, and limited structural integrity.

It is therefore believed, that this invention can offer considerable improvements over traditional aluminum pontoon boats by integrating the seat base faces, inner helm station, and inner side railings into the fiberglass deck above the floor level, and integrating the seat backs, interior modules, and side railings into the fiberglass hull. By dividing the seat bases and interior components into an inner molded section, and an outer molded seat back and side railing, the invention will solve many issues of interior space utilization, and construction efficiency that has prevented fiberglass pontoon boats from being fully molded in Fiberglass.

DESCRIPTION OF RELATED ART

Fiberglass construction for use in watercraft is known in the art. For example, U.S. Pat. No. 5,209,177 discloses a pontoon type boat including a fiberglass deck and a fiberglass modified tunnel hull. The deck includes a storage compartment partially formed in the deck of the craft. The storage compartment has a cover portion capable of being positioned flush with the deck of the boat when closed in order to conceal the interior of the storage compartment. However, U.S. Pat. No. 5,209,177 shows a deck that is consistent with typical aluminum pontoon construction, in that it forms a flat floor base upon which aluminum side rails, and rotationally molded seat bases are added to complete the deck assembly. Fiberglass has simply replaced the plywood floor, and been incorporated into the hull. Additionally, the cover portion of the storage compartment extends down from its upper surface with four vertical surfaces, identically to traditional aluminum pontoon boat construction. A traditional aluminum side fence is placed on the outside of the fiberglass console to conceal the console from the outside of the boat.

It is the intention of this invention, to create a new method of integrating the outer portions of the seating modules, head modules, helm modules, and other assemblies into the molded hull, in order to allow greater interior space, while integrating several interior components to increase manufacturing efficiency.

U.S. Pat. No. 7,987,803 discloses a pontoon boat with claim 1, wherein the pair of pontoons is composed of at least one of aluminum, polystyrene, fiberglass, metal, and concrete. Cochran teaches that the pontoons are slidingly, or removably affixed. This differs from the subject invention, wherein the pontoon hulls are intentionally integrated to add efficiencies in the building process, and to utilize the depth inside the pontoon for interior accommodations.

BRIEF SUMMARY

It is an object of the present invention to construct a pontoon-style boat out of fiberglass, having raised and integrated fiberglass side rails. Embodiments of the subject invention have a flat floor, from bow to stern and side to side, and a side entry gate that features an entrance level with the flat floor. Preferred embodiments have integrated seat bases molded in fiberglass in both the hull and deck. The subject invention also provides a method of joining the hull and deck together by flexing the hull in order to compensate for the opposing draft angles of the hull and deck at the side entry door.

BRIEF DESCRIPTION OF THE FIGURES

FIGS. 3A and 3C are cross-sectional, front end views and FIGS. 3B and 3D are exterior side views.

FIGS. 4A, 4B, 4C, 4D, and 4E show a comparison between a traditional pontoon boat with a flat floor and separate furniture modules and side rails (FIGS. 4A, 4B and 4C) and a partial view of a pontoon boat of the subject invention with an extended hull integrated with the back side of a seat module (FIG. 4D). FIG. 4E is a cross-sectional front end view showing how a standard seat module (dotted lines) requires more floor space than the seats integrated with a deck of the subject invention.

DETAILED DESCRIPTION

Constructing a pontoon boat almost entirely out of fiberglass requires new techniques and methods to correctly mold the associated fiberglass parts so that they fit together when assembled. Since pontoon boats that are built of aluminum typically utilize furniture components, helm stations components, and side railings that are placed or arranged onto a flat floor, their construction techniques are fairly simple and straightforward. Pontoon boats with fiberglass molded hulls and flat floor fiberglass decks can also be straightforward to build according to the subject invention, since they too rely on furniture and all similar components placed and arranged on top of the flat floor. In fact, most interior components such as furniture, components, side railings, and helm stations are interchangeable between the two types of boats, and can be utilized for traditional pontoon boats constructed of aluminum, or molded fiberglass flat floor pontoon boats as well.

Embodiments of the subject invention incorporate the side rails and backs sides of the seating components, modules, and helm consoles that are normally bolted or secured to the deck of a traditional pontoon boat, into the hull of the boat. In particular embodiments of the subject invention, these side rails will also serve the main function of being integrated as the structural back or side of any of a variety of interior components (45), such as, for example, seats, and helm modules, and therefore allow these interior components (45) to be built as part of the two larger pieces, each fitted together. The two pieces, formed as unitary structures, can be considered as inner and outer portions, with the outer portions being integrally molded into the hull as one large molding, and the inner portion being integrally molded as one large piece with the deck, including the flat floor, as well as, other interior components (45) like seats, furniture, consoles, and most other related interior components integrated with and extending upward from the floor.

Figure 1:
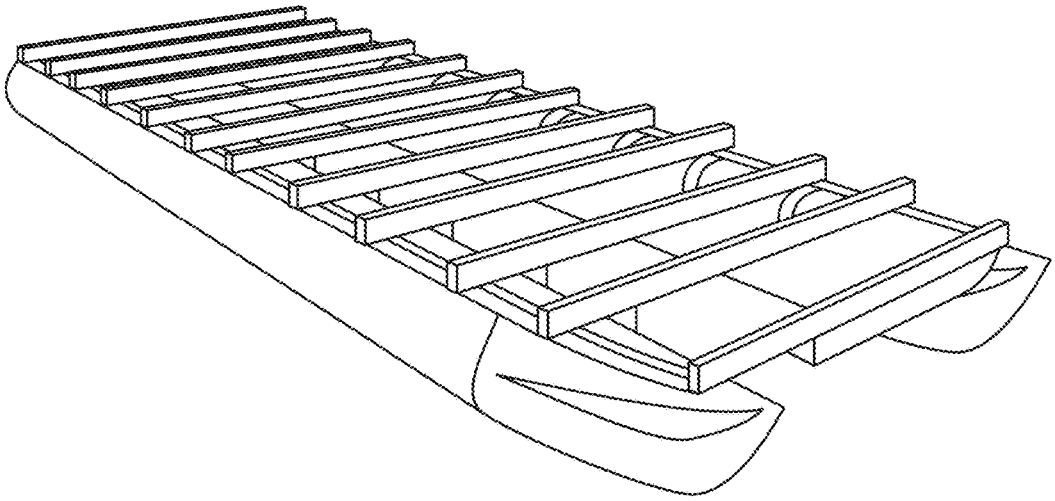
FIG. 1 (prior art)
FIG. 1 illustrates a grid that forms the foundation of a traditional pontoon boat.
Figure 2:
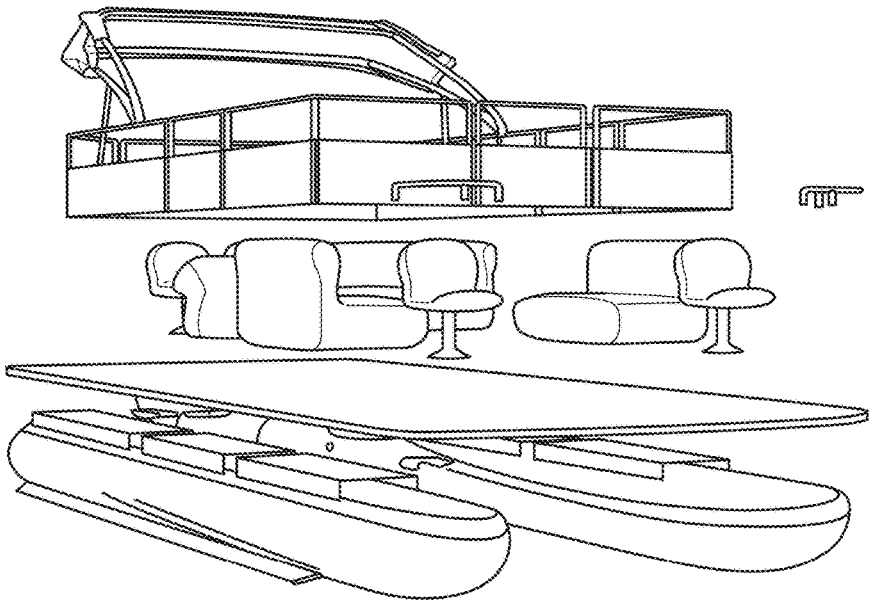
FIG. 2 (prior art)
FIG. 2 is an exploded view that illustrates various fixtures that can be arranged and secured in place on a traditional pontoon boat.
Figures 3A, 3B, 3C, 3D:
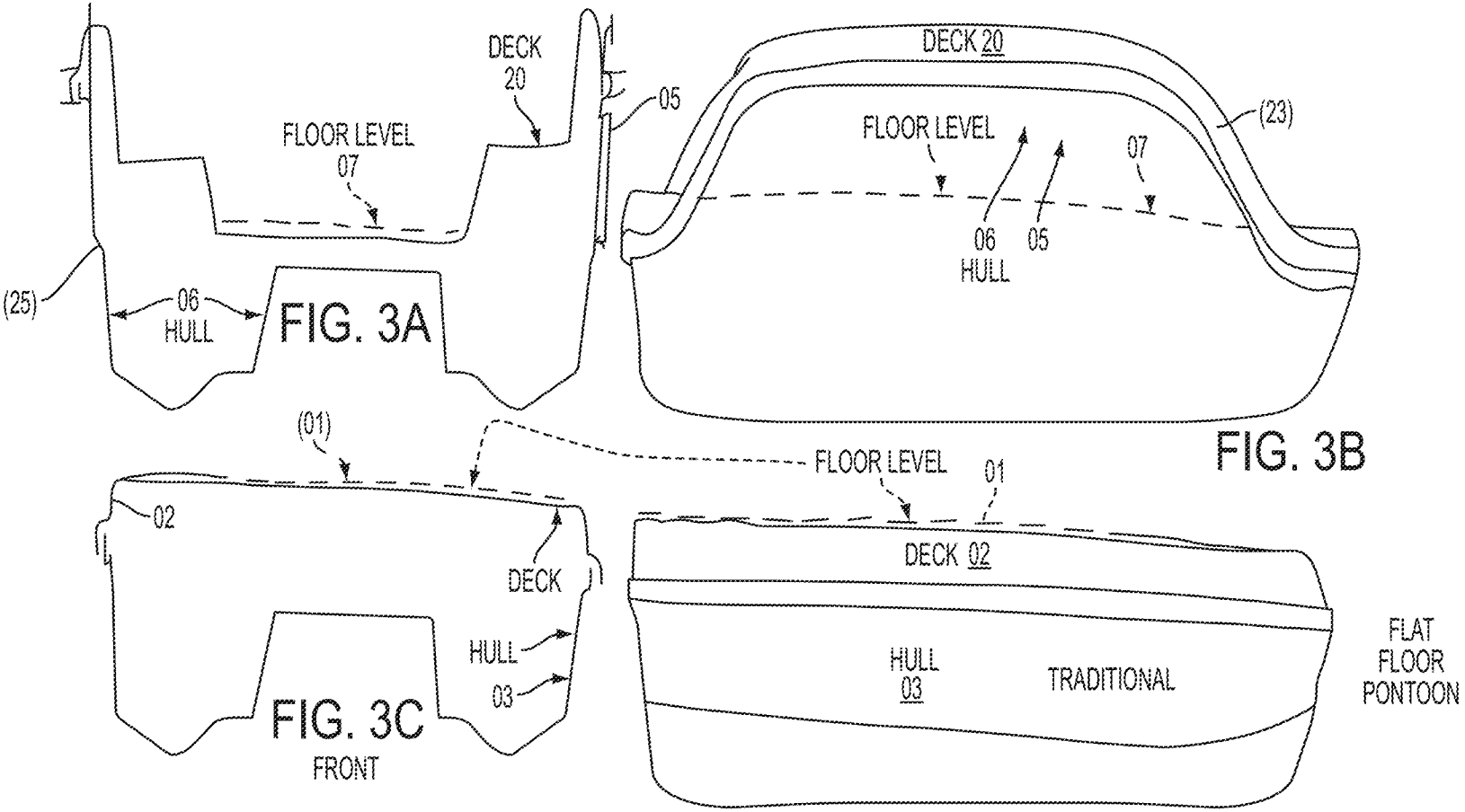
FIGS. 3A, 3B, 3C, and 3D show a comparison between the construction of a hull of the subject invention (FIGS. 3A and 3B) and a standard pontoon hull construction (FIGS. 3C and 3D).

Referring to the figures, it can be seen that FIGS. 3A-D shows a comparison between a standard pontoon construction method of joining the flat deck(02) with a flat floor(01) to the hull(03) (FIGS. 3C and 3D), and the construction method of this invention, which incorporates the side rails (05) as integrally molded into the hull(06), which extends upwards on both sides. The side rails extend down to the floor(07) level near the bow of the boat, and near the stern, in order to allow the flat floor entrance at either end, as shown in FIG. 3B. The floor(07) of the improved hull and deck of the subject invention retains a flat profile from bow to stern, and only extends upward to integrate interior components, such as the furniture and fittings, which are usually located in between the forward and aft boarding platforms.

Figure 4E:
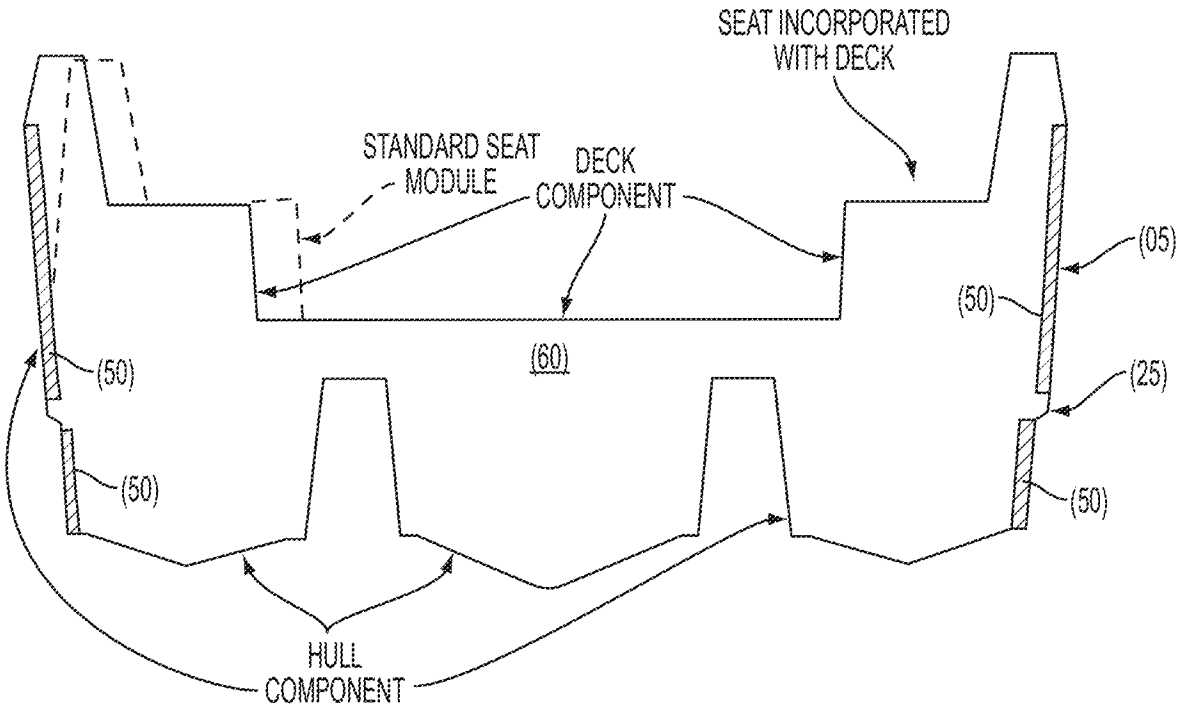

FIGS. 4A, 4B, 4C, 4D and 4E are cross-sectional views that illustrate a comparison between a traditional pontoon boat with a flat floor(01) and separate furniture modules(09), for example, rotationally or "roto" casted and/or fiberglass molded seats, and side rails(08) (FIG. 4A), and the embodiments of the subject invention, which utilize an extended hull(06) that integrates the back side of the seat module (46) and side rail(05) (FIG. 4D). The comparison seen in FIGS. 4A-D shows a traditional pontoon boat with both a conventional aluminum side rail(08) and a rotationally molded seat module(09), and a separately molded fiberglass seat module (10) (FIG. 4A). In the case of the aluminum side rail(08) and rotationally molded seat module(09), it can be seen that the construction method of the rotationally molded seatback keeps the seat back section narrow, as seen in FIG. 4B. The addition of the side rail(08) to hide the rough nature of the seatback(13) from the outside of the boat requires a measurable amount of floor space that has to be subtracted from the overall interior width (W) of the boat, as seen in FIGS. 4A and 4E. The shape necessitated by separate fiberglass seat modules(10) utilizes even more floor space than the rotationally molded seat base(09), as illustrated in FIG. 4C.

Figure 5:
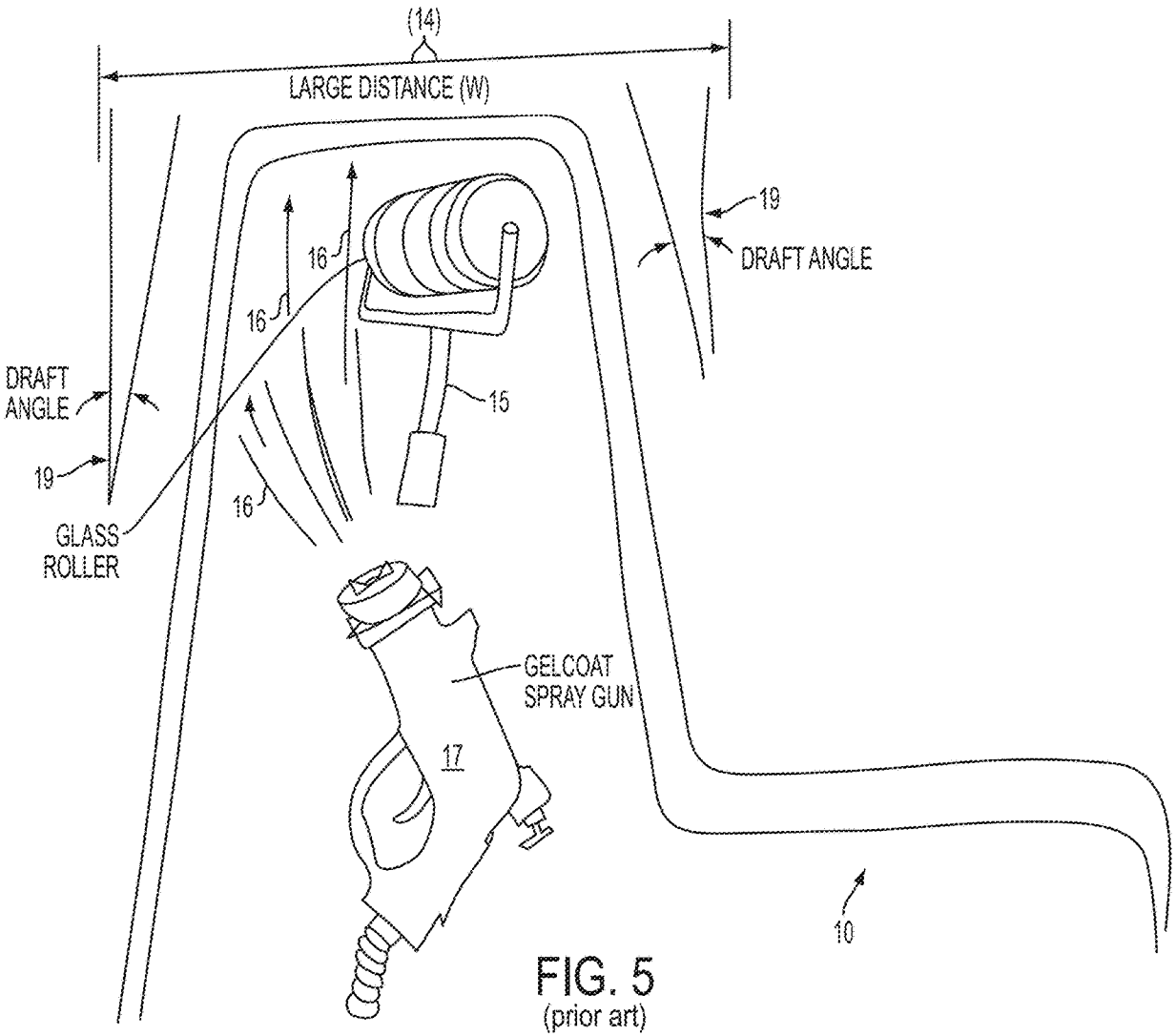
FIG. 5 (prior art)
FIG. 5 shows an example of the width (W) required by traditional style, separate seat modules used on standard pontoon boats. Typical molding techniques often dictate that the style of seat modules have a sufficient draft angle (19). Also illustrated are a typical gel coat spray gun and glass roller used in the manufacture of fiber glass components.

FIG. 4E also illustrates how the pontoons of the subject invention are incorporated and formed as part of the hull design. It can be seen that the pontoons are essentially hollow spaces formed within the hull and the side rails extend upward from the outer hull walls that define the hollow spaces of the port and starboard pontoons. When the deck (20) and the hull(06) are assembled, at least two spaces (60) or hollow areas are formed between the deck and the hull, which form the pontoons, such that the pontoons are substantially open to the underside of the deck. As will be discussed below, this void (60) that forms the pontoons can also be useful as a storage or access area. In FIG. 5 that the necessary width of the traditional style separate fiberglass seat module(10) is dictated by construction techniques. Two factors contribute to the overall width of a fiberglass part: draft and access. The first factor, draft, simply refers to the necessary angles(19) of a part that is constructed in a mold, so that it can be extracted or is able to "pull out" of the mold. Generally speaking, 3' per surface is acceptable in molding techniques, so that given the nature of the part to shrink in the mold, it will not lock it into the mold, and 3' should allow the part to "pull out" without dragging too much of the mold release agents from the surface of the mold. In the case of a tall part, or a deep mold, other factors, such as, for example, heat buildup, can contribute to the necessary amount of draft angle(19) required in order to pull parts successfully from the mold. For parts that are taller, a 3' draft multiplied over the height of the part can create a very wide part. In the case of a seat back, it can result in a large distance(14) from the back of the seat to the forward side, which can be undesirable, as it encroaches into usable interior width.

The second contributing factor in the required distance (14) from the back of the seat to the forward side is access requirements. The nature of fiberglass construction requires an operator or machine to apply "Gelcoat" to the mold surface. Gelcoat is the exterior "paint like" colored surface of a fiberglass part that is visible to the eye. Gelcoat is typically sprayed through a spray gun(17), such as shown by way of example in FIG. 5, or is brushed on in limited cases. This gelcoat is most often sprayed onto a mold in a manner and consistency that allows it to flow freely(16), however, it cannot be applied unevenly, or too thick, or else it will later crack or become distorted. Fiberglass molds must also be designed correctly, in order to allow adequate airflow(16) for the gelcoat application process, as well as facilitate other manufacturing factors. Once gelcoat is applied, a barrier coat of fiberglass mat or chop, is either sprayed from a gun similar to the gelcoat gun(17)—also requiring airflow management as well(16), or it can be laid into a mold by hand, which requires an access large enough for workers to carefully place the glass fibers into the shape. Fiber glass, whether hand laid, or sprayed in by a chopper gun also needs to be manually rolled out with a glass roller(15), also shown, by way of example, in FIG. 5, in order to force any air between the layers out from the back side. After this process is complete, structural fiberglass, most often employed in the form of woven sheets, is then manually manipulated into place and is also rolled out with a glass roller(15). Since the use of spray guns(17), requirements for airflow allowances (16), and the need for manual manipulation of materials by hand with a glass roller(15) requires considerable maneuvering room, production friendly fiberglass parts are usually designed with large access cavities. These large access cavities are disadvantageous for seat bases, since seat bases will, ideally, be as narrow as possible in order to allow the maximum usable interior width. Consequently, fiberglass is rarely used in pontoon boats for separately molded seating base modules.

Figure 6A:
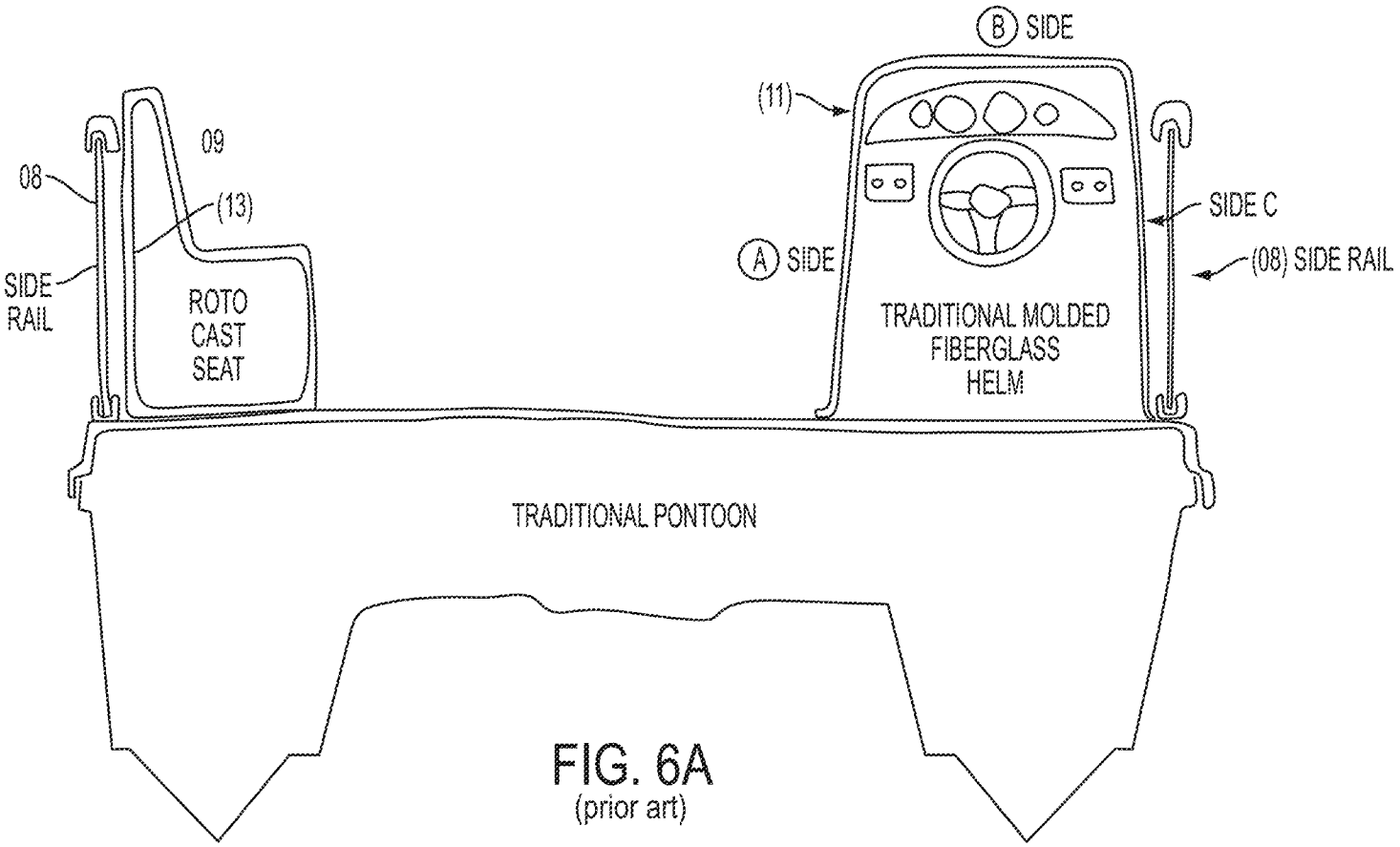
FIG. 6A (prior art)
FIGS. 6A and 6B are cross-sectional, front end views that show a comparison between a traditional pontoon boat helm station and seat module molded as separate components and mounted to the floor inside the side rails (FIG. 6A) and a helm station and seat of the subject invention that are molded as part of the side rails (FIG. 6B).
Figure 6B:
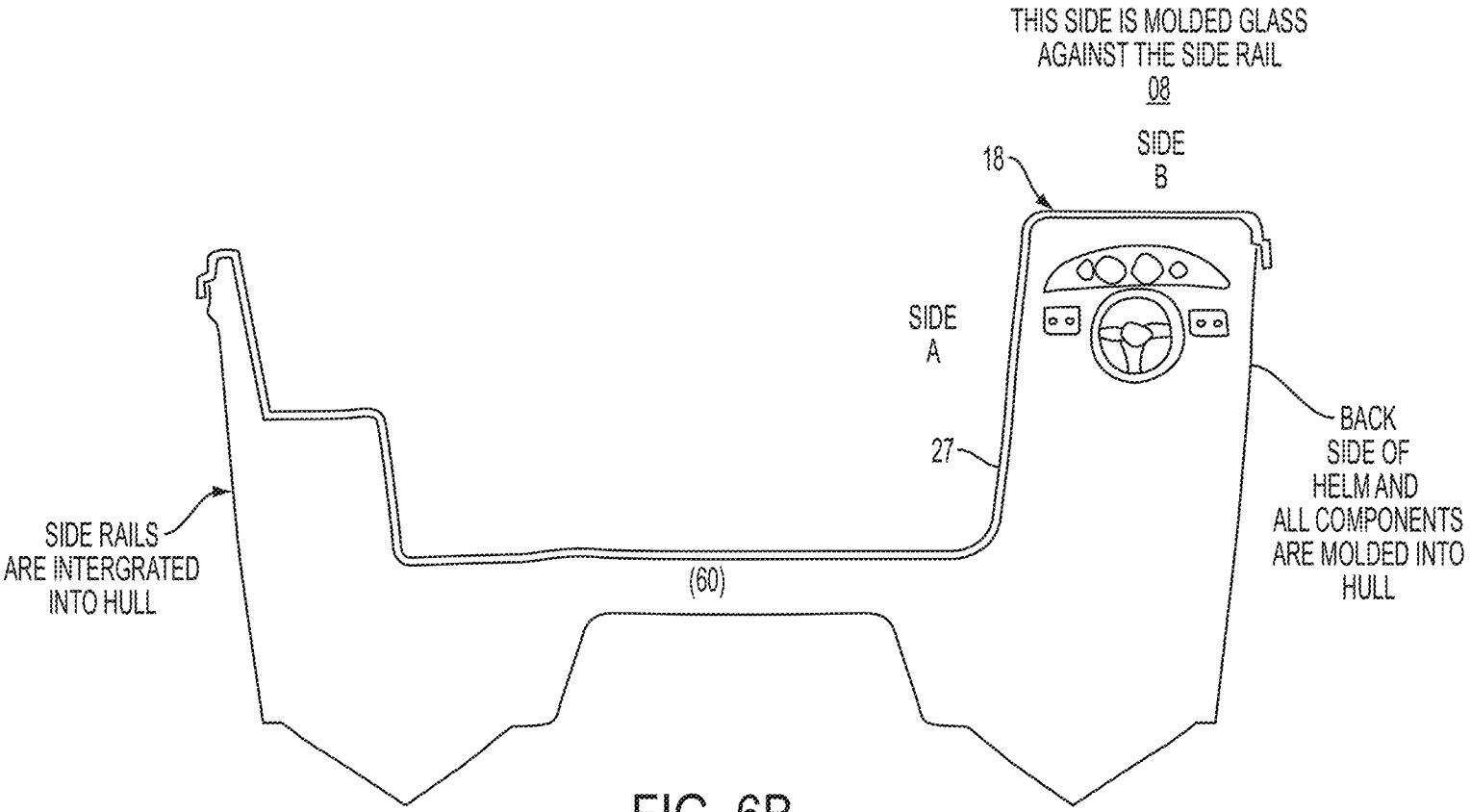

Looking a FIGS. 6A and 6B, there is illustrated a comparison between a traditional pontoon boat utilizing a fiberglass helm station(11) (FIG. 6A), and a pontoon boat according to the subject invention that integrally molds the outer surface of the helm station (27), or helm station receiver, into the extended side rails(05) (FIG. 6B). Since the traditional helm station(11) is generally a large wide structure, it is usually acceptable, and is most often molded out of fiberglass. A helm station is mounted inside the side railings(08) in order to improve the look of the traditional pontoon boat. However, due to manufacturing constraints, the outside surface of the helm console(11) often has a measureable amount of draft(19) in order to facilitate removal from the fiberglass mold, so there is often a measureable amount of space lost or wasted in the construction of the traditional pontoon boat.

The embodiments of the subject invention utilize a helm station(18) comprised of two pieces, with the inner portion being molded integrally into the deck(20), and the outer portion being integrally molded into the extended side rails(05) of the hull(06). This allows the usable space of the helm(18) to be at least equal to that of a traditional pontoon boat helm(11), while allowing it to be mounted further to the side of the boat, which can maximize interior width.

Figure 7B:
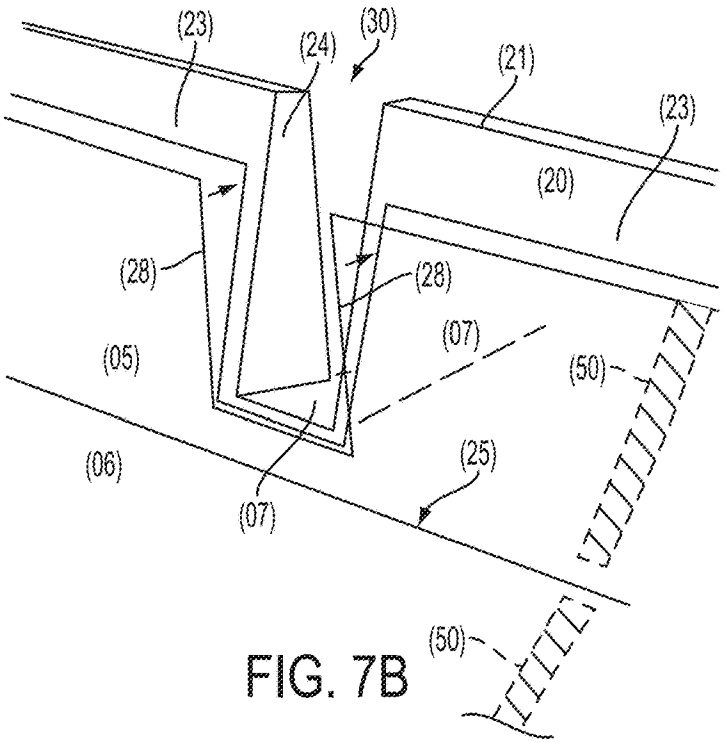
FIGS. 7A and 7B illustrate embodiments of an improved method for manufacturing the integrated side rails of a fiberglass hull of the subject invention at the side entry step to be level with the floor.
Figure 7A:
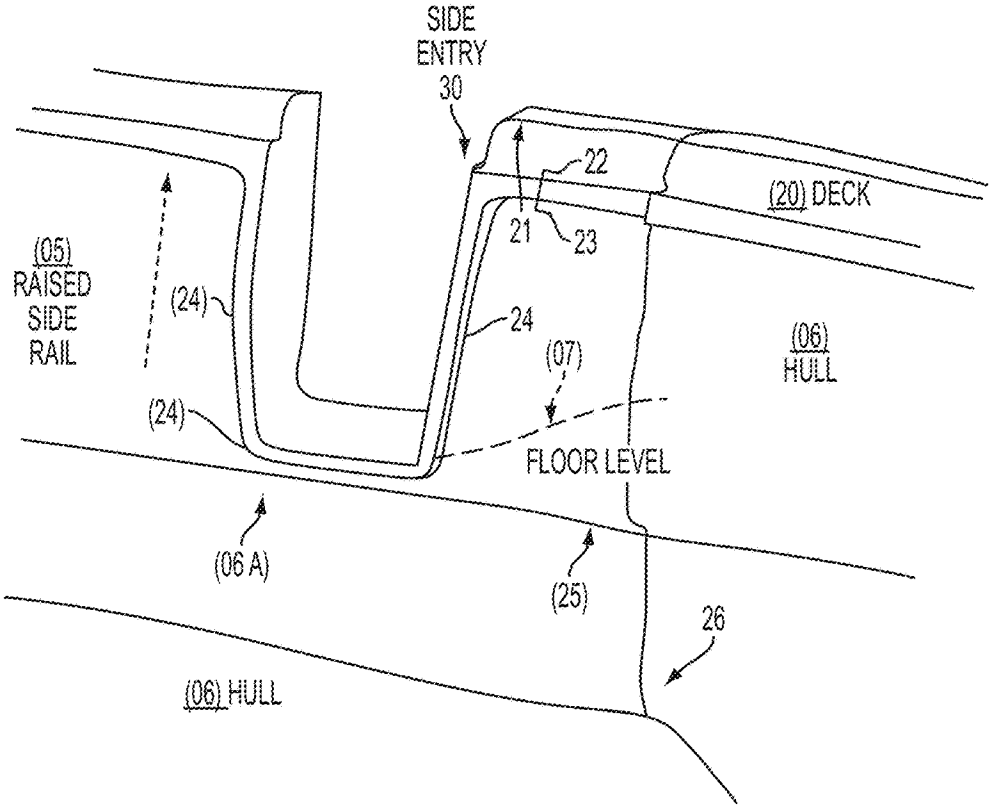
Figure 15:
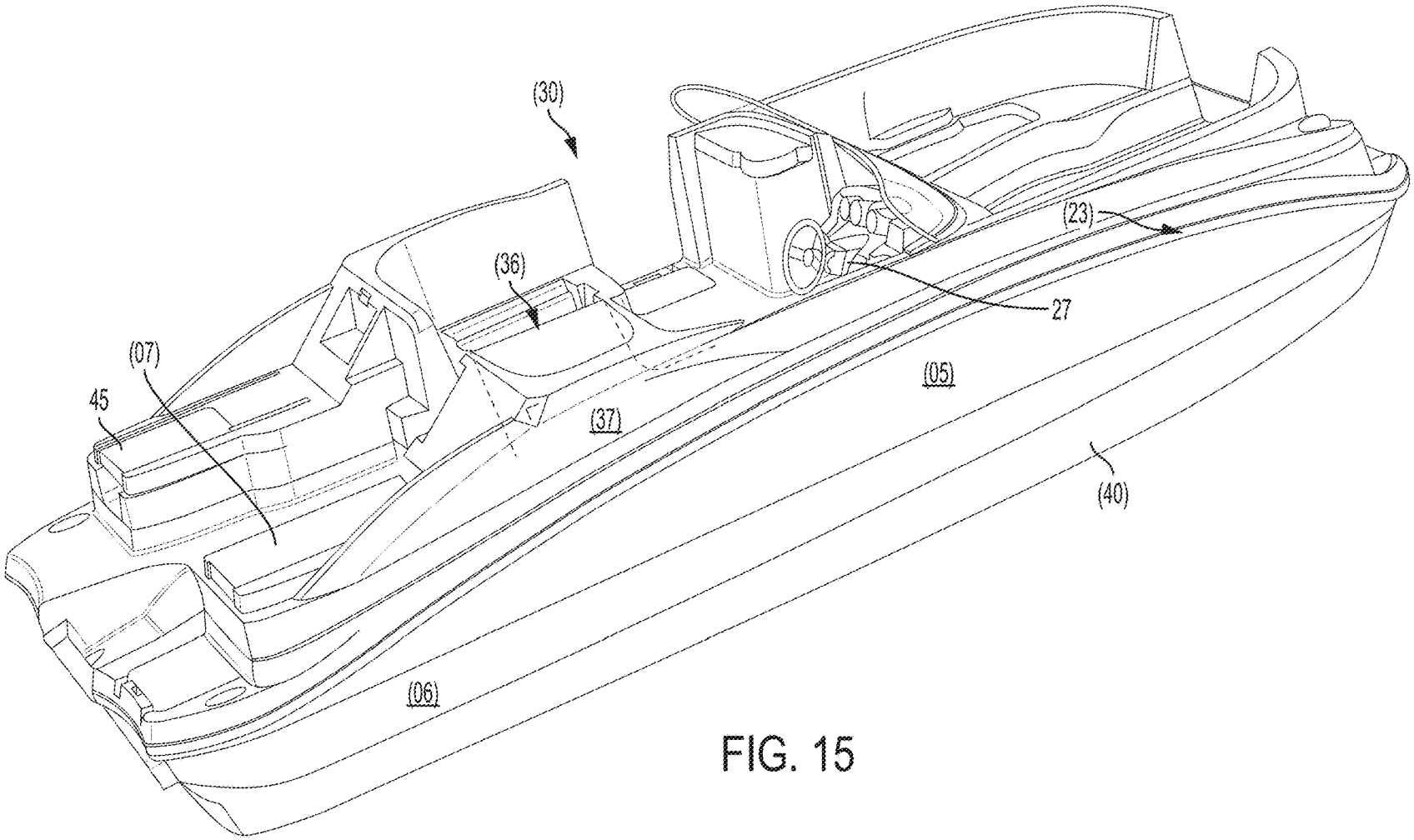
FIG. 15 shows a port side stern-end perspective view of a pontoon boat embodiment of the subject invention.
Figure 16:
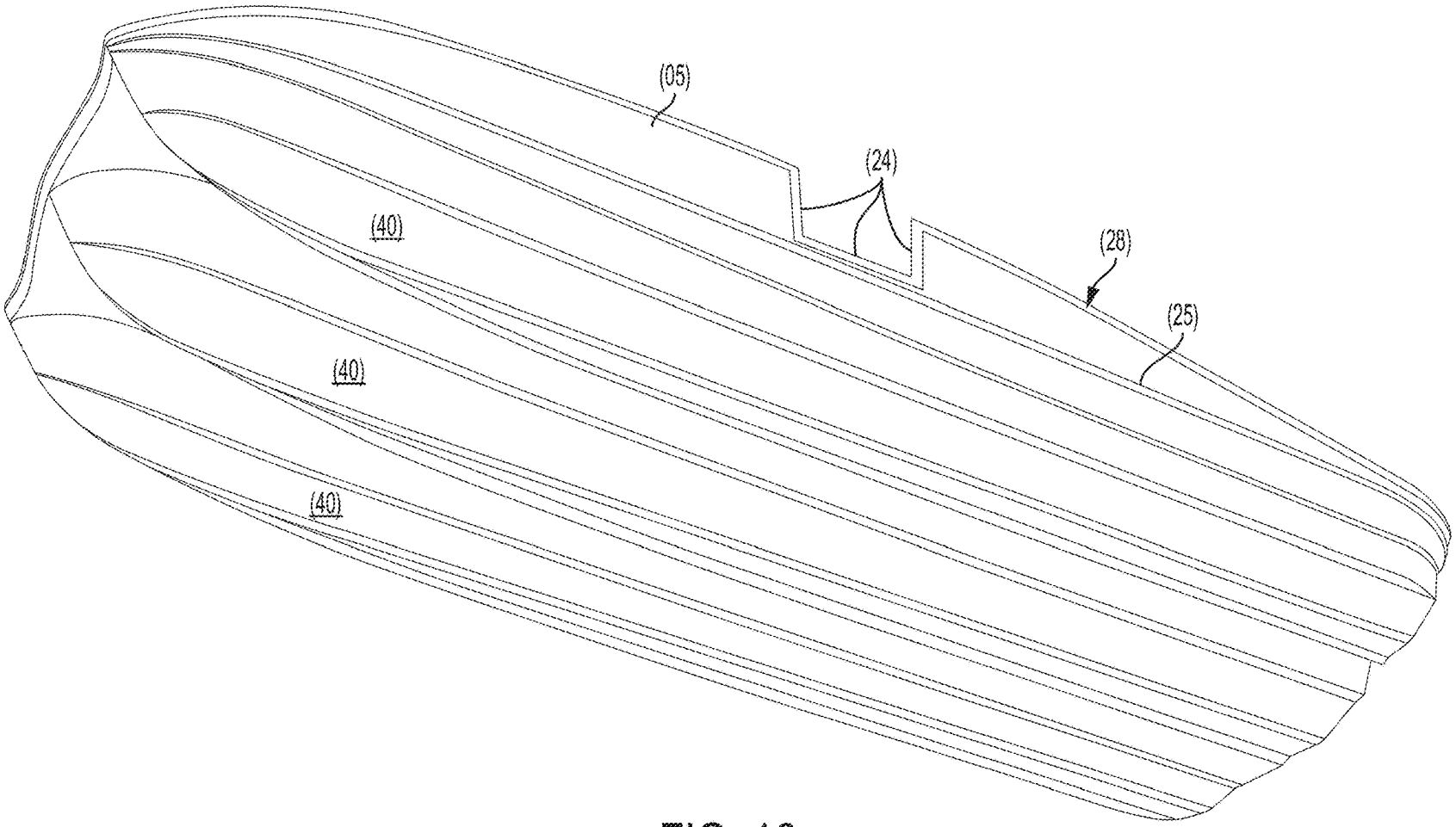
FIG. 16 shows a bottom bow-end perspective view of a hull embodiment of the subject invention.
Figure 17:
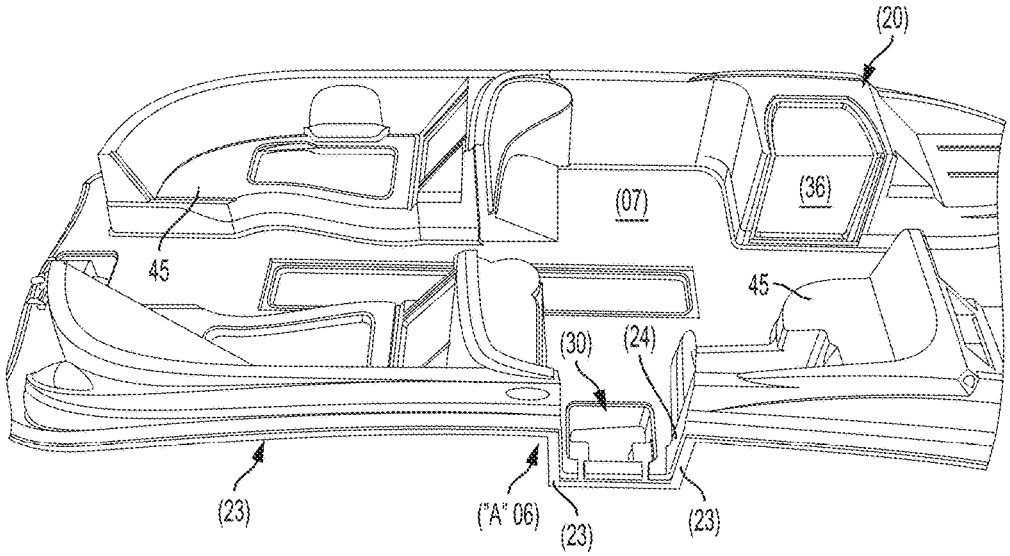
FIG. 17 shows a top port side perspective view of a deck of the subject invention.
Figure 18:
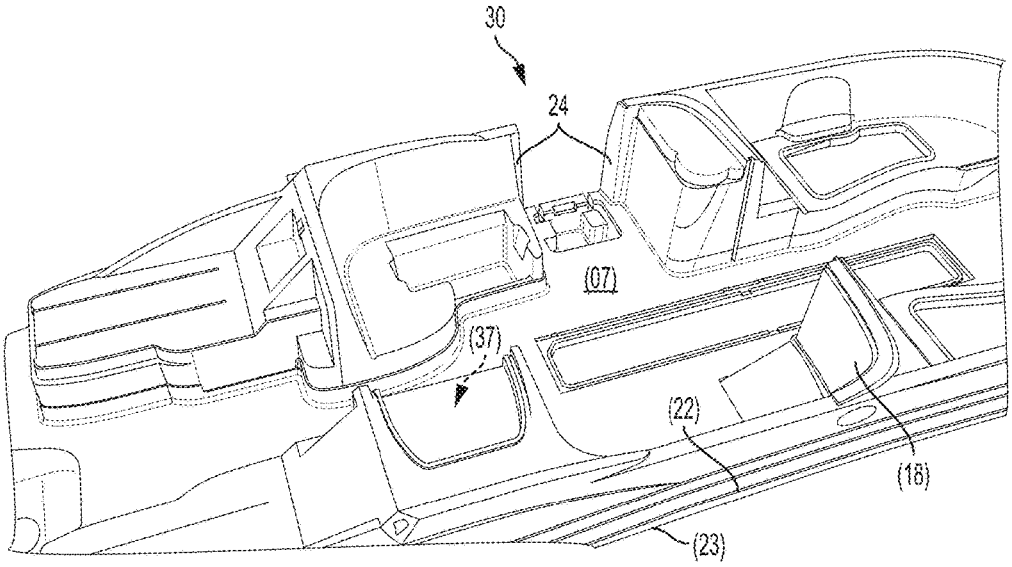
FIG. 18 show a starboard side top perspective view of a deck of the subject invention.
Figure 19:
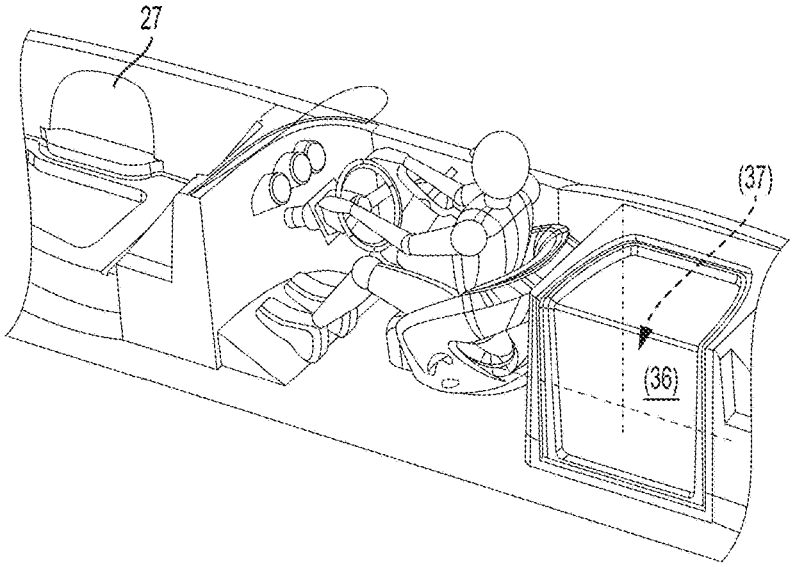
FIG. 19 shows a cut-away view of a deck to illustrate a helm station embodiment of the subject invention.
Figure 20:
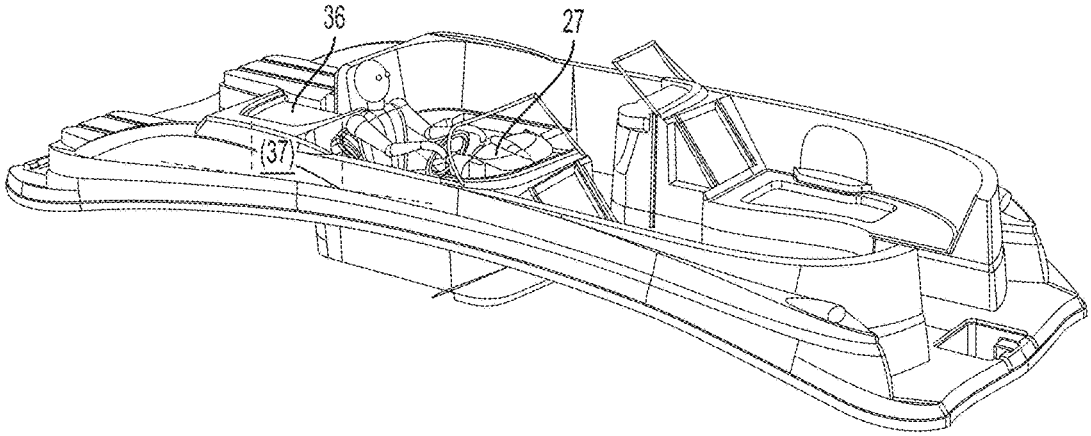
FIG. 20 is a starboard side bow-end perspective view of a deck embodiment of the subject invention.
Figure 21:
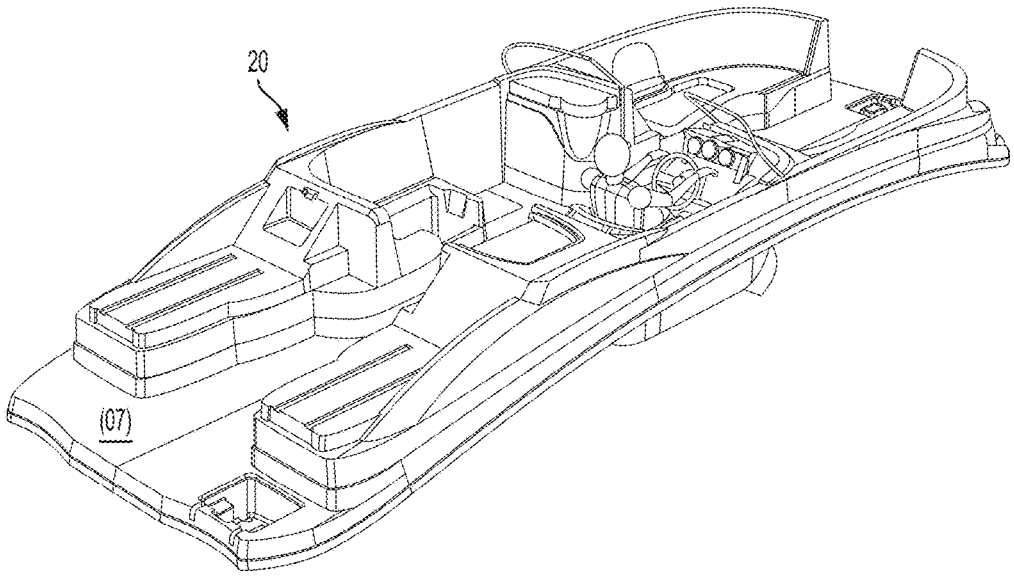
FIG. 21 is a starboard side stern-end perspective view of a deck embodiment of the subject invention.
Figure 22:
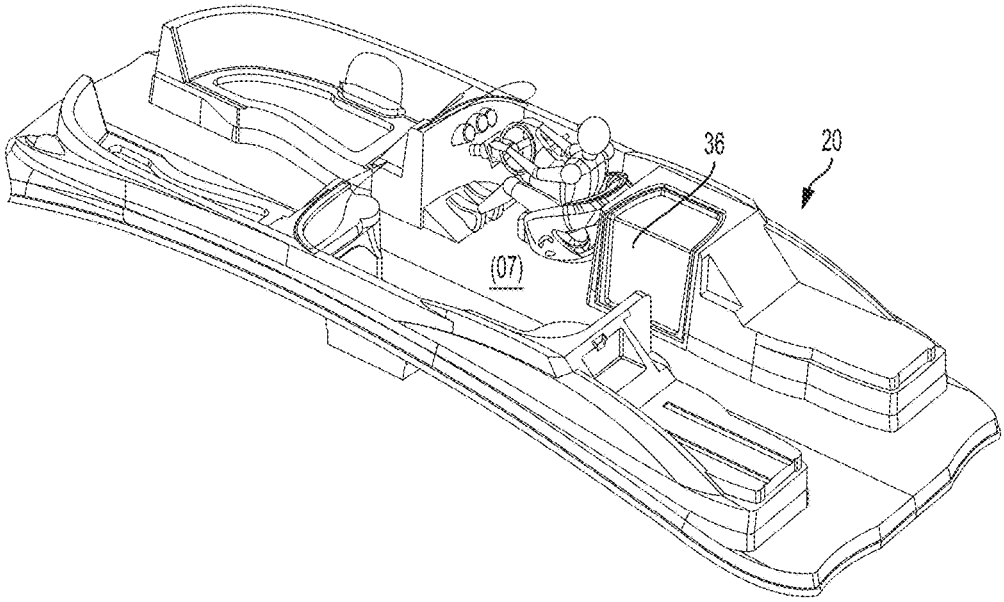
FIG. 22 shows a port side stern-end perspective view of a deck embodiment of the subject invention.

In FIGS. 7A and 7B there is illustrated an improved method for building the integrated side rails(05) of the fiberglass hull(06) at the side entry step that is level with the floor(07). A side entry (30) is generally a passage way within the port and/or starboard side of the boat that allows passengers or objects to be easily passed into and out of the boat without having to go over the side rails. FIG. 15 provides an example of a side entry (30) formed within a side rail and hull of the subject invention.

As previously discussed, both the hull(06) and deck(20) will have the required draft angles in order to allow them to be "pulled out" of their respective molds. Advantageously, the respective draft angles for these components do not cause interference anywhere in the construction of the boat, except for the side entry area(30). The side entry(30) of the boat has conflicting draft areas, because the side entry extends upward from the flat floor level(07) of the deck(20) to the top of the deck, which is noted as style line(21). This height is over 24" tall, however, greater or lesser heights can encounter the same draft issues. The deck(20) terminates at its lowest molded point, where excess fiberglass flanges are trimmed off. This cut line at the bottom of the deck is called the deck trim flange(23). The hull(06) incorporates the integral side rails(05) which extend upward and terminate at a similar trim flange called the hull trim flange(28) (seen on FIG. 8). When assembled, the hull trim flange(28) of the hull(06) operatively engages with the deck trim flange (23), by slipping underneath the deck trim flange(23), so that the hull trim flange(28) sits inside a knuckle(22) molded into the deck. This is a commonly used practice, and is often referred to as a "shoebox fit", as seen, for example in FIG. 8). This is the typical method of joining a fiberglass hull to a fiberglass deck.

Embodiments of the subject invention further incorporate the integrally molded side rails(05) and side entry(30) with a flat floor(07), which creates construction issues usually not found in other construction applications. Because the hull (06) gets wider, or bows outward, closer to the top, or near the hull trim flange(28) due to the required draft angle, and the deck(20) also gets wider closer to the bottom of the boat, or towards the deck trim flange, also due to its required draft angle, the conflicting draft angles require a new method of building a boat with integrated fiberglass side rails. As seen in FIG. 7B, when the hull(06) is joined with the deck, the conflicting angles necessitate that the hull trim flange area be manipulated by being bent or pushed, as indicated by the arrows in FIG. 7B, so that it can fit under and be operably engaged with the deck trim flange(23).

Figure 8:
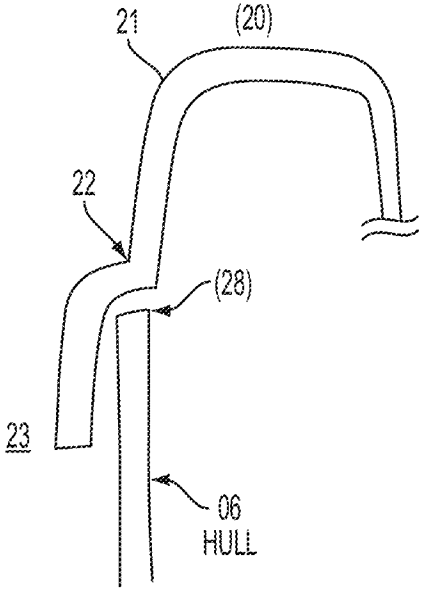
FIG. 8 illustrates an example of hull and deck joint details. Specifically shown is an embodiment of a "shoebox fit," wherein the hull trim flange on the hull is positioned underneath a deck trim flange so as to fit into a knuckle molded into the upper deck.
Figure 10:
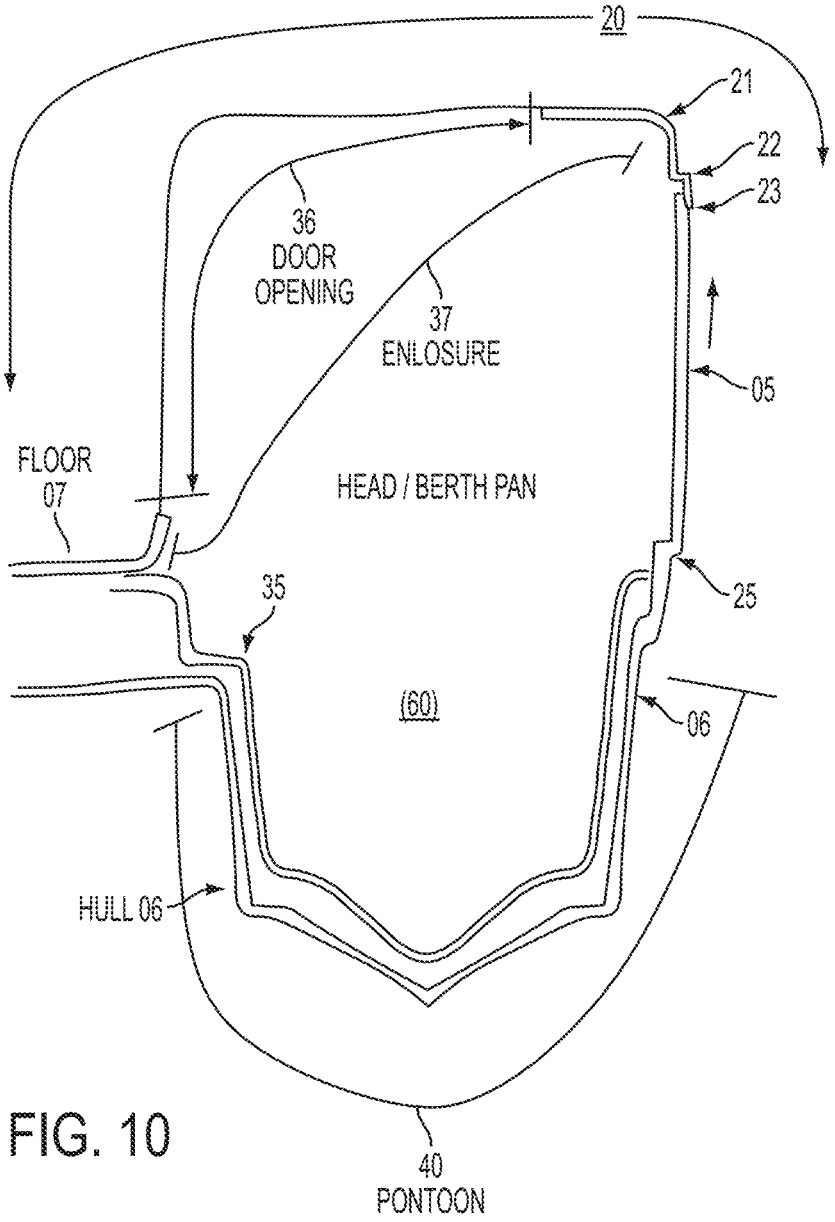
FIG. 10 is a cross-section front end view that illustrates an embodiment of an enclosed step-down head compartment, according to the subject invention.

FIG. 10 is a cross-sectional view that illustrates one embodiment of an improved method for creating an enclosed step-down combined head compartment and quarter berth. The subject invention allows penetration of the floor(07), because the integrated side rails(05) in the hull (06) extend up to the deck(20) at the trim flange(23). As seen in FIGS. 8 and 10 and in FIG. 11, a side view, the deck(20) integrates an enclosure(37) from the top style line(21) inboard, in a manner to form the enclosure(37) which is accessed from an opening(36) that can be covered with a door. The enclosure(37) utilizes the space created by integrally molding the pontoon(40) into the hull(06) to create a sufficiently large compartment that can accommodate, for example, both a toilet facility, and a quarter berth(38) that extends underneath the flat floor(07) on either side of the integral enclosure(37) after it terminates back down to the floor(07) or other integrally molded components in the deck(20). The interior of this enclosure can be finished with an additional molded head/quarter berth pan(35) that can protect the pontoon. Alternatively, the interior of the hull(06) can be finished with traditional vinyl and carpeting or other components.

Figure 11:
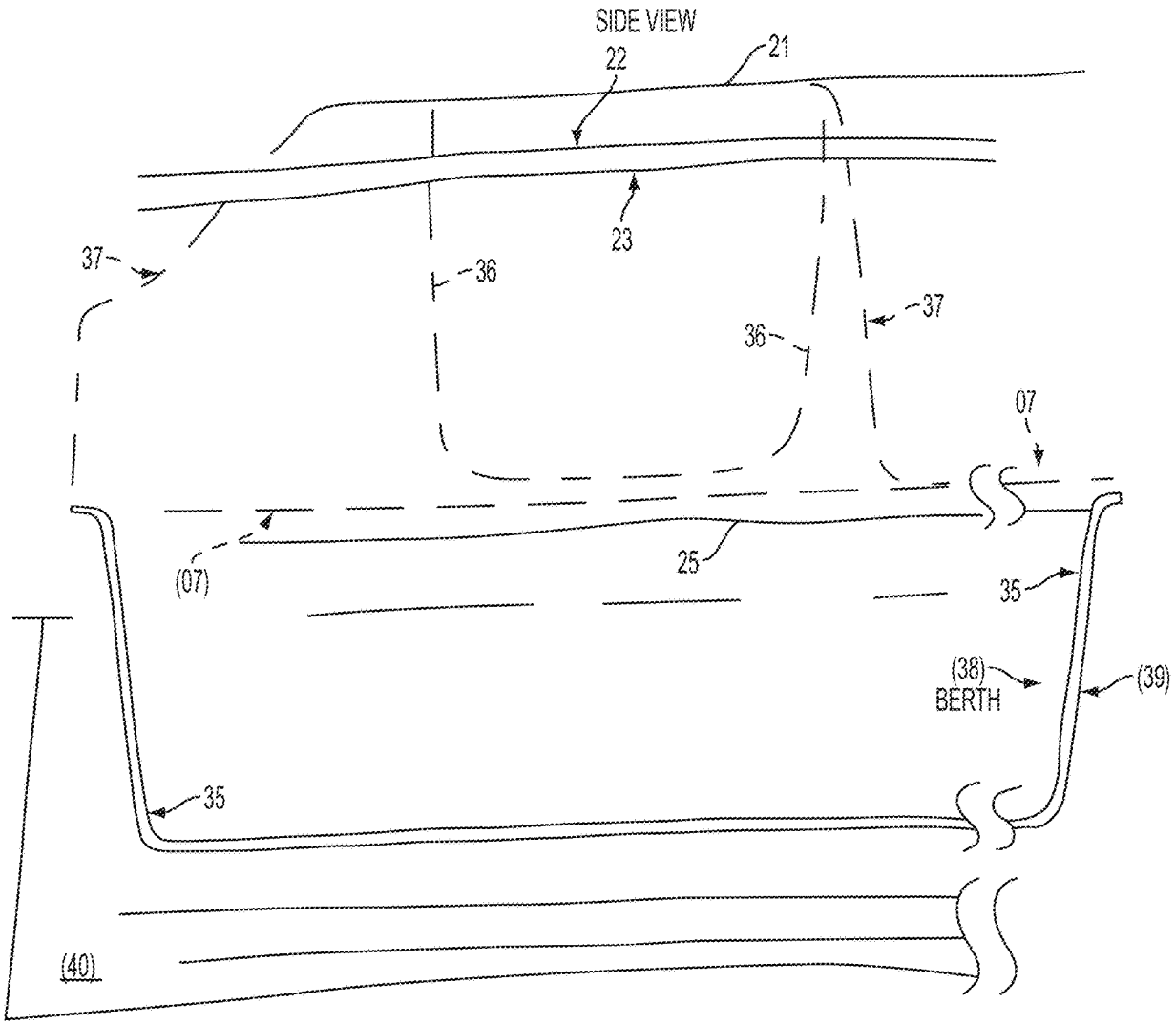
FIG. 11 illustrates a head/quarter pan embodiment of the subject invention and shows how it can be used to provide a quarter berth by extending a forward lower enclosure wall within a pontoon.
Figure 12:
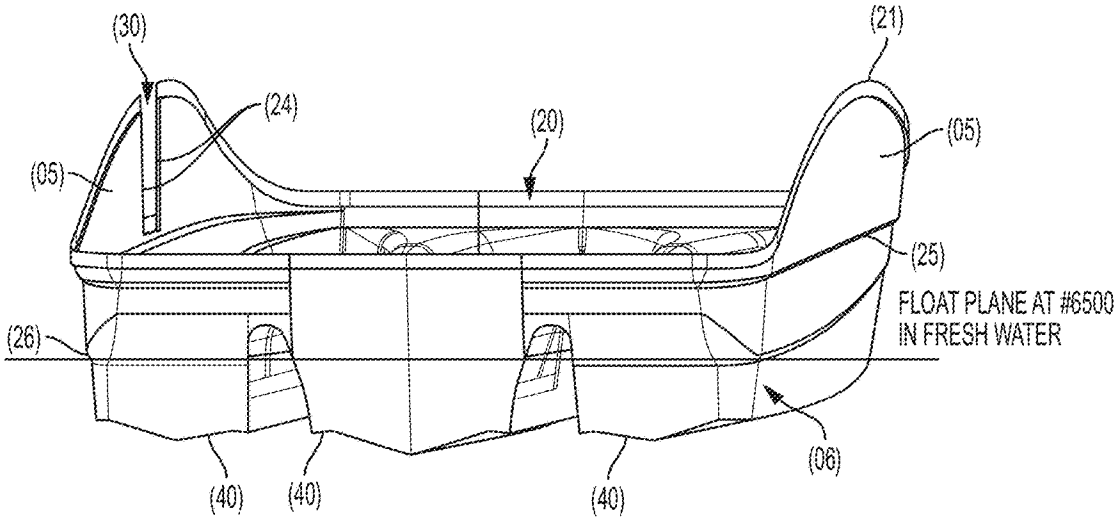
FIG. 12 shows a stern-end perspective view of an embodiment of a pontoon boat of the subject invention.
Figure 13:
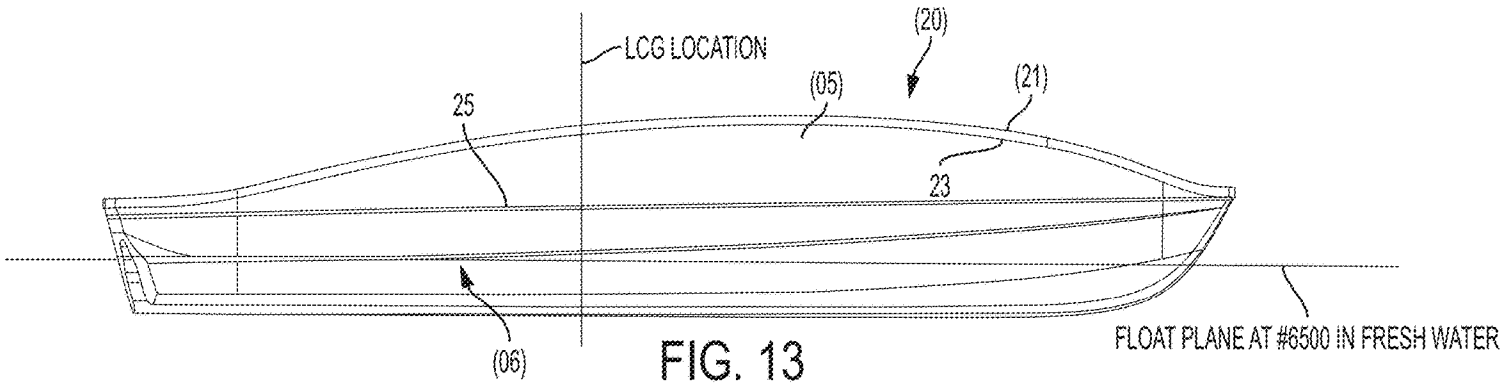
FIG. 13 shows a side elevation view of an embodiment of a pontoon boat of the subject invention.

FIG. 11 provides a side view that illustrates how the head/quarter berth pan(35) can create the quarter berth(38) by extending the forward lower enclosure wall(39) past the enclosure wall(37) where it intersects the flat floor(07) or other integrally molded seating modules, or components, inside the space created by the integrally molded pontoon (40) in the hull(06). Conversely, the quarter berth(38) may also extend aft under the flat floor(07), or other integrally molded seating modules or components, by utilizing the available space inside the molded pontoon(40).

Since the deck(20) can be molded with any of a variety of details, corners, and style lines, it will ideally be a very rigid part, and will ideally resist flexing and bending. Consequently, it can be difficult to change the molded shape of the deck once it is pulled from the mold. Embodiments of the subject invention provide a new method of building a hull(06) that will allow it to be sufficiently stiff underneath and at the running surface, but is also designed to flex at a given hinge point(25), extending generally horizontally along the side rail(05), as shown, for example, in FIGS. 9, 12, 13, and 16, in order to allow the integrated side rails(05) to flex inward to fit under and be attached to the deck trim flange(23). Since the deck (20) is very rigid, its trim flange (23) will also be very rigid and stiff, and will usually not give way or flex considerably when physically joining with the hull(06).

Figure 9:
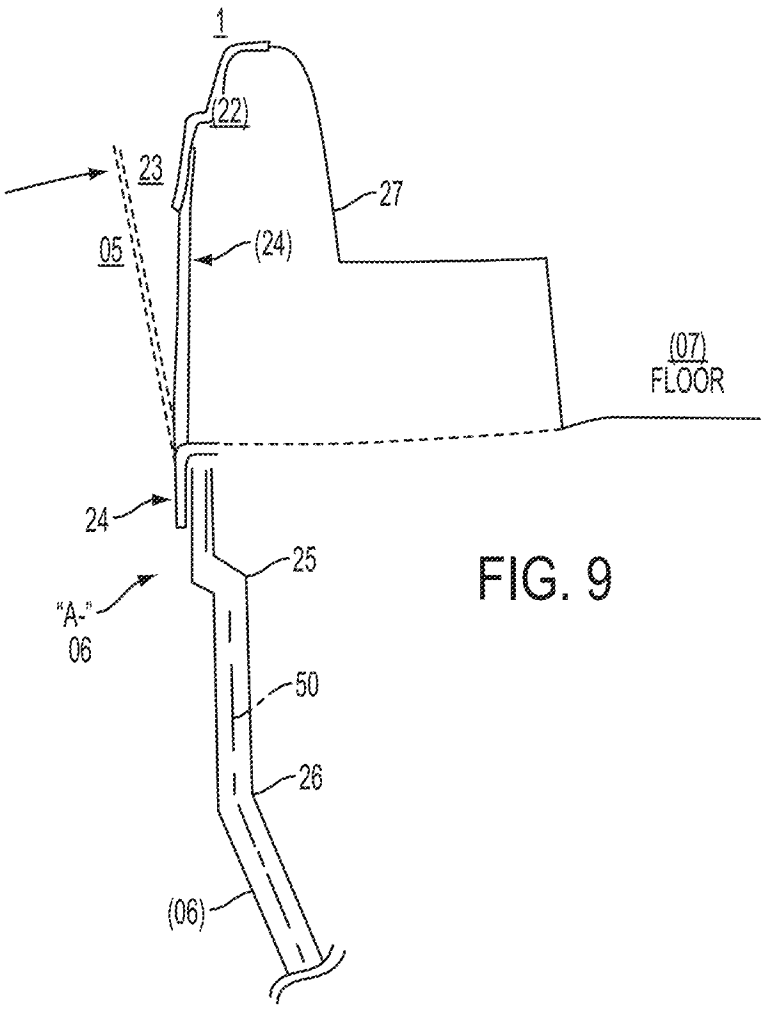
FIG. 9 illustrates a method of the subject invention for manufacturing an integrated side rail of a fiberglass hull where the side entry step is located so that it is level with the floor of the deck.
Figure 14:
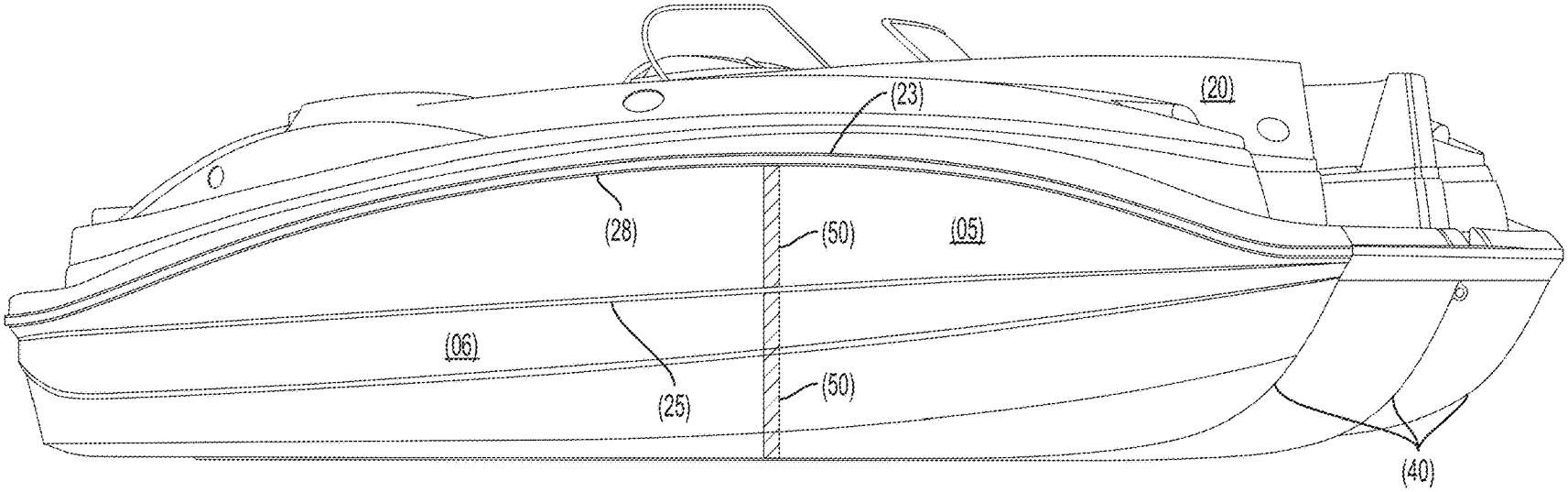
FIG. 14 shows a port side bow-end perspective view of a pontoon boat embodiment of the subject invention.

Core structures are commonly used in boat construction to lend rigidity and stability to large areas of fiber glass or other materials. Core structures (50) can also be used during the construction of a hull (06) of the subject invention to strengthen the side rails (05). In one embodiment, core structure (50) is placed between layers of fiberglass or other material used in the manufacture of the hull, an example of which is shown in FIG. 9. In a further embodiment, the core structure is interrupted at the hinge point (25) so that the core structure does not cross the hinge point, which would inhibit the ability of the hinge point to flex. Thus, there can be a break in the core structure where it approaches the hinge point, such as seen, by way of example in FIGS. 4E, 7B, and 14. This allows the core structure to support the material, but does not prevent the side rails (05) from being flexed inward during assembly of the deck (20) and hull (06).

In a specific embodiment, the trim flange(23) on the port and starboard sides extends downward to the lowest part of the flat floor(07). This vertical surface(24) of the trim flange will get slightly wider at the bottom of the door opening(30). The vertical trim surface(24) and flat floor(07) will ultimately contact a point on the hull, where the hull is formed as a cut-out (12), at a location specified as(A 06) on FIGS. 7 and 9. This point in the hull(A 06) will be narrower than the hull trim flange (28), since the draft of the hull(06) dictates that it be wider towards the top. Embodiments of the subject invention provide a design for a hull(06) with a specific flex point(25) that is located in a manner that it will intersect with the vertical trim flange(24) of the deck(20) at the height of the flat floor (07). In this manner, the rigid deck(20) will join with the hull(06) at a specifically designed rigid point(25). In a further embodiment, the hull(06) is designed so that statically, it will not fit the deck (20) due to its increasing draft from the (A 06) point of the hull(06). However, flexing of the integrated raised side rails (05) from the hinge point(A 06) will allow them to bend in and the hull trim flange (28) will fit under the deck trim flange(23) and correctly sit inside the deck knuckle (22). An example of this is shown in FIG. 7B, where the arrows indicate the bend direction of the hull.

The subject invention provides a new method of fiberglass, or similar, construction that will allow a hull (06) with integrally molded side rails(05) to be successfully mated to a unitary deck (20) component that incorporates a side entry door(30) to permit access to a flat floor(07) similar to popular aluminum pontoon boats.

I claim:

1. A pontoon boat comprising:

a deck comprising a floor and at least one interior component integrated with and extending upward from the floor, where at least a portion of an edge of the deck terminates in a deck trim flange; and a hull comprising at least two hollow spaces extending downward and at least two side rails that extend upward respectively from outer hull walls that define the at least two hollow spaces, wherein the at least two side rails and at least a portion of the hull terminate in a hull trim flange, such that when the deck and hull are assembled, the hull trim flange operatively engages beneath the deck trim flange so that at least one of the at least two side rails engages with the at least one interior component forming the pontoon boat having a space beneath the deck resulting in at least two pontoons that each respectively comprises one of the at least two hollow spaces.

2. A pontoon boat according to claim 1, wherein the at least one interior component is a seat and one of the at least two side rails forms a back side of the seat.

3. A pontoon boat according to claim 2, wherein the at least one interior component is a helm station and one of the at least two side rails forms a side of the helm station.

4. A pontoon boat according to claim 3, wherein the deck further comprises a side entry where the deck trim flange extends to the floor and the hull further comprises a cut-out that corresponds with the side entry;

such that when the cut-out in the hull is aligned to where the deck trim flange extends to the floor during assembly of the deck and hull, the cut-out in the hull will operatively engage with the side entry beneath the deck trim flange, such that the floor of the deck will overlap the hull at the side entry.

5. A pontoon boat according to claim 1, wherein the at least one interior component is a head compartment and one of the at least two side rails foul's a side of the head compartment to provide an enclosed space between the deck and at least one of the pontoons, wherein the deck further comprises an opening into the head compartment.

6. A pontoon boat according to claim 5, further comprising a head/berth pan within the head compartment that covers at least a portion of one of the at least two hollow spaces.

7. A pontoon boat according to claim 1, wherein the hull further comprises a hinge point along a length of at least one of the side rails.

8. A pontoon boat according to claim 7, further comprising a core structure attached to an interior of the hull.

9. A pontoon boat according to claim 8, further comprising a break in the core structure at the hinge point.

10. A pontoon boat according to claim 1, wherein the deck trim flange forms a knuckle in which the hull trim flange engages with the desk trim flange.

* * * * *